US006442906B1

(12) United States Patent
Hwang

(10) Patent No.: US 6,442,906 B1
(45) Date of Patent: Sep. 3, 2002

(54) ELEVATION-ADJUSTABLE ROD MEMBER LOCKING STRUCTURE

(76) Inventor: Hsin Tsai Hwang, No. 354, Ho Sin Road, Chunan Industrial District, Miaoli Hsien (TW)

( * ) Notice: Subject to any disclaimer, the term of this patent is extended or adjusted under 35 U.S.C. 154(b) by 0 days.

(21) Appl. No.: 09/963,378

(22) Filed: Sep. 27, 2001

(30) Foreign Application Priority Data

Aug. 1, 2001 (TW) ..... 90213013 U

(51) Int. Cl.[7] ..... E04B 9/00
(52) U.S. Cl. ..... 52/126.6; 248/188.4
(58) Field of Search ..... 248/188, 188.2, 248/188.3, 188.4, 357, 354.3, 354.4; 52/126.5, 126.6, 126.7

(56) References Cited

U.S. PATENT DOCUMENTS 5,398,466 A * 3/1995 Oyama et al. ..... 52/126.6
5,758,854 A * 6/1998 Shih ..... 248/354.3
5,791,096 A * 8/1998 Chen ..... 52/126.6
5,983,582 A * 11/1999 Vugrek ..... 52/126.6 X
6,347,489 B1 * 2/2002 Marshall, Jr. et al. . 52/126.6 X
6,349,512 B1 * 2/2002 Berkey et al. ..... 52/126.6

* cited by examiner

*Primary Examiner*—Ramon O. Ramirez
(74) *Attorney, Agent, or Firm*—Bacon & Thomas, PLLC

(57) ABSTRACT

An elevation-adjustable rod member locking structure is disclosed, which includes a locating socket fixedly fastened to an end of a tubular upright post, the locating socket having an inward shoulder, an adjustment nut threaded onto a screw rod and supported on the shoulder, the adjustment nut having an outward flange, and a lock screw threaded into the locating socket and stopped at the top side of the outward flange of the adjustment nut to lock the adjustment nut with the locating socket.

6 Claims, 6 Drawing Sheets

ELEVATION-ADJUSTABLE ROD MEMBER LOCKING STRUCTURE

BACKGROUND OF THE INVENTION

1. Field of the Invention

The present invention relates to an elevation-adjustable rod member locking structure, which enables two rod members to be axially adjusted to change the combined length, and can positively lock the rod members in position.

2. Description of Related Art

FIG. 6 shows an elevation-adjustable upright support for supporting a raised floor in a computer room or clean room according to the prior art. This structure of elevation-adjustable upright support comprises a tubular upright post 92, a socket 921, and adjustment nut 93, and a screw rod 91. The socket 921 is fixedly provided at the top of the tubular upright post 92, having a recessed circular receiving hole 922. The adjustment nut 93 is threaded onto the screw rod 91 and supported on the top side of the socket 921, having a downward shank 931 inserted into the recessed circular receiving hole 922 of the socket 921. Rotating the adjustment nut 93 causes the screw rod 91 to be moved axially to the desired elevation. This design of elevation-adjustable upright support is not satisfactory in function. The contact between the downward shank 931 of the adjustment nut 93 and the recessed circular receiving hole 922 of the socket 921 is insufficient to absorb side force or vibration. When people walk on the raised floor, the elevation-adjustable upright support may be forced to produce noise. A vibration may cause the adjustment nut 93 and the screw rod 91 to fall from the socket 921. Further, the rod members (the screw rod 91 and the tubular upright post 92) can bear only downward compressive force. When pulling the screw rod 91 upwards with the hand, the adjustment nut 93 will be disconnected from the socket 921, i.e., the rod members (the screw rod 91 and the tubular upright post 92) cannot protect against upward stretching force.

Therefore, it is desirable to provide an elevation-adjustable rod member locking structure that eliminates the aforesaid drawbacks.

SUMMARY OF THE INVENTION

The main object of the present invention is to provide an elevation-adjustable rod member locking structure, which enables two rod members to be axially adjusted to change the combined length, and can positively lock the rod members in position. It is another object of the present invention to provide an elevation-adjustable rod member locking structure, which provides a high locking power, enabling the locked rod members to bear high compressive force as well as stretching force. It is still another object of the present invention to simplify and cost down an elevation-adjustable rod member locking structure.

To achieve these and other objects of the present invention, the elevation-adjustable locking structure comprises a locating socket, an adjustment nut, and a lock screw. The locating socket is fixedly fastened to an end of a tubular upright post, comprising an inner thread extended to the topside thereof and a shoulder inwardly disposed in the bottom side thereof. The shoulder has a top face. The adjustment nut is mounted inside the locating socket and supported on the shoulder, comprising an inner thread threaded onto a screw rod, a peripheral wall, an operation unit at the top side of the peripheral wall, and an outward flange at the bottom side of the peripheral wall. The outward flange has a top face, and a bottom face supported on the top face of the shoulder of the locating socket. The lock screw is adapted to lock the adjustment nut in the locating socket, comprising an annular inside wall sleeved onto the peripheral wall of the adjustment nut, a head around the periphery thereof at the topside, an outer thread threaded into the inner thread of the locating socket, and a bottom edge supported on the top face of the outward flange of the adjustment nut. When rotating the adjustment nut clockwise/counter-clockwise after loosened the lock screw, the screw rod is forced to move upwards/downwards to the desired elevation. After adjustment, to rotate the lock screw downwards would force its bottom edge against the top face of the outward flange, then the bottom face of the outward flange is forced against the top face of the shoulder accordingly. Therefore, the locating socket, the adjustment nut, and the lock screw are all locked together.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
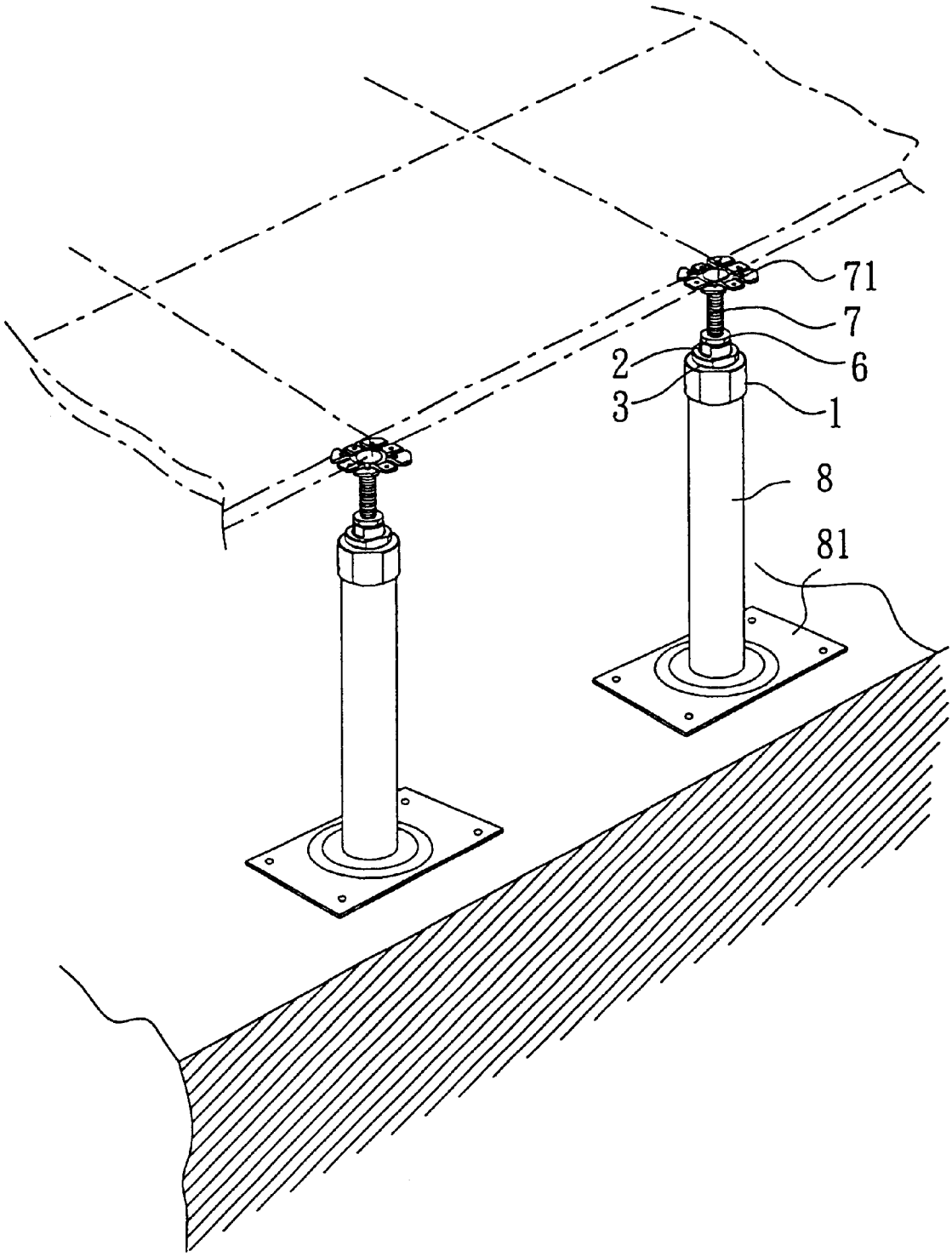
FIGS. 1 is an applied view of the present invention showing the elevation-adjustable rod member locking structure used in a raised floor supporting structure.

FIG. 1 shows an elevation-adjustable rod member locking structure constructed according to a first embodiment of the present invention. This embodiment is designed for use in an elevation-adjustable support to support a raised floor in a computer room or clean room. The elevation-adjustable support comprises a tubular upright post 8, the tubular upright post 8 having a flat bottom mounting plate 81 fixedly fastened to the floor, a screw rod 7 inserted into the tubular upright post 8, the screw rod 7 having a flat head 71 adapted to support a plurality of raised floor, and an elevation-adjustable rod member locking structure provided between the screw rod 7 and the tubular upright post 8 and adapted to adjust the elevation of the screw rod 7 and to lock the screw rod 7 in the adjusted position.

Figure 2:
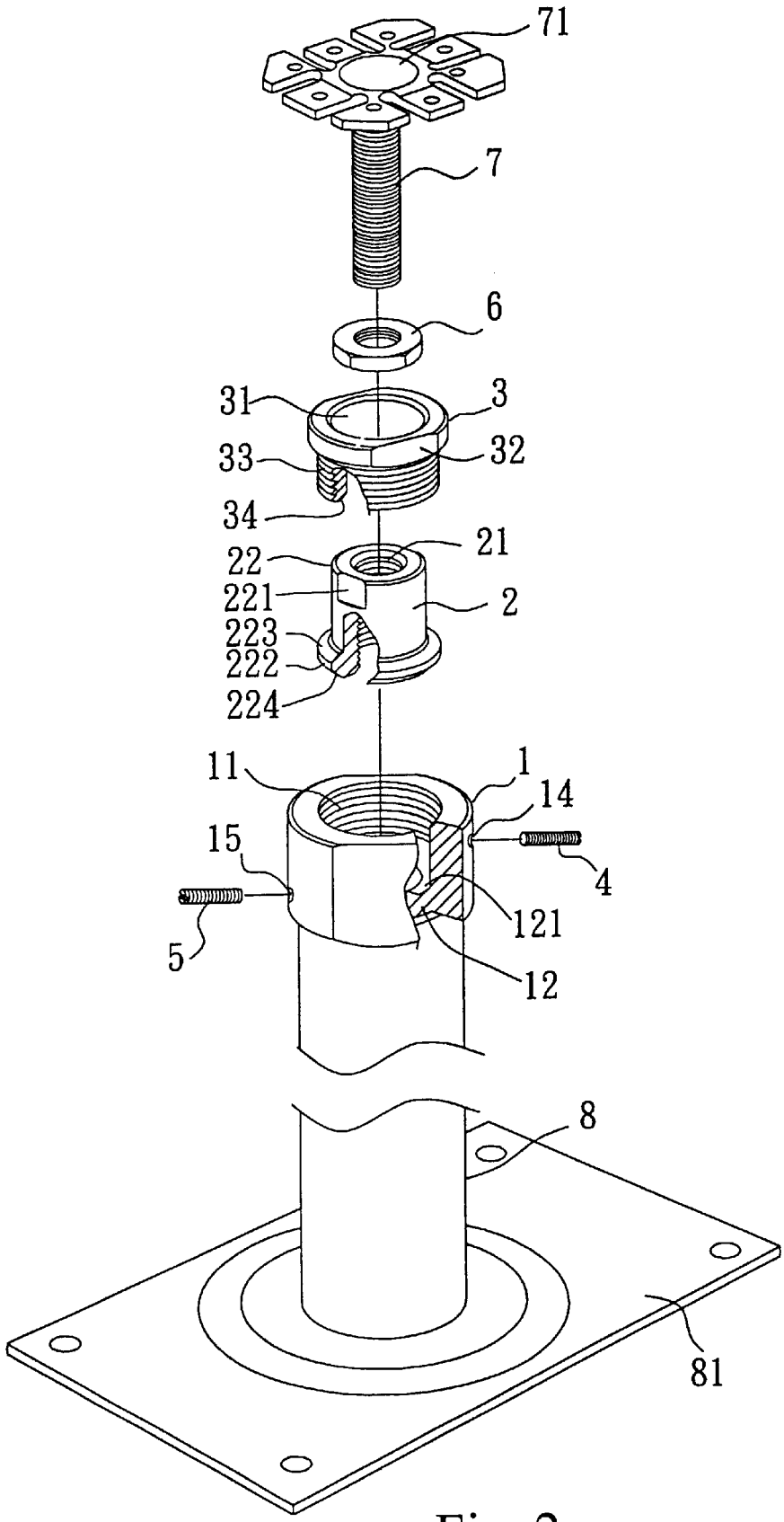
FIG. 2 is an exploded view of an elevation-adjustable rod member locking structure according to a first embodiment of the present invention.
Figure 3:
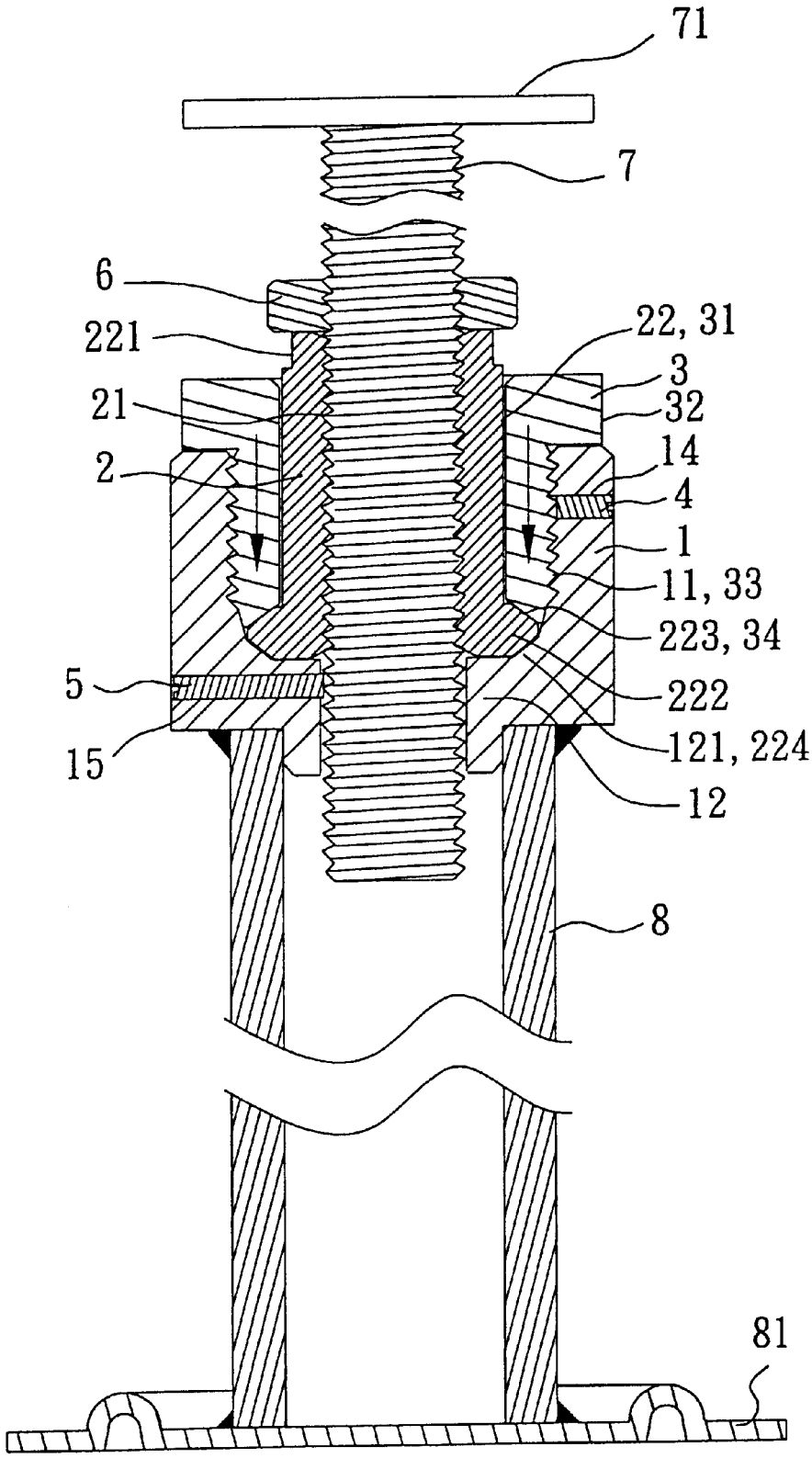
FIG. 3 is a sectional assembly view in an enlarged scale of the first embodiment of the present invention.

Referring to FIGS. 2 and 3, the elevation-adjustable rod member locking structure comprises a locating socket 1, an adjustment nut 2, and a lock screw 3. The locating socket 1 is fixedly fastened to the top end of the tubular upright post 8, comprising an inner thread 11 spirally extended to the top side thereof, and a shoulder 12 inwardly disposed at the bottom side thereof. The shoulder 12 has a top face 121.

The adjustment nut 2 comprises an inner thread 21 threaded onto the screw rod 7, an operation unit 221 at the upper part of the periphery 22, and an outward flange 222 at the bottom side of the periphery 22. The outward flange 222 has a top face 223 and a bottom face 224. After insertion of the adjustment nut 2 into the locating socket 1, the bottom face 224 of the outward flange 222 of the adjustment nut 2 is supported on the top face 121 of the shoulder 12 of the locating socket 1. According to this embodiment, the bottom face 224 of the adjustment nut 2 and the top face 121 of the shoulder 12 are tapered faces matching each other.

The lock screw 3 comprises an annular inside wall 31 sleeved onto the periphery 22 of the adjustment nut 2, a head 32 around the periphery of the top side thereof, an outer thread 33 threaded into the inner thread 11 of the locating socket 1, and a bottom edge 34 supported on the top face 223 of the outward flange 222 of the adjustment nut 2. According to this embodiment, the bottom edge 34 and the top face 223 are tapered surfaces matching each other.

Further, a check nut 6 may be threaded onto the screw rod 7 and supported on the topmost edge of the adjustment nut 2.

When attaching a wrench to operation unit 221 to rotate the adjustment nut 2 clockwise/counter-clockwise, the screw rod 7 is forced by the inner thread 21 of the adjustment nut 2 to move axially upwards/downwards. Because the bottom face 224 of the adjustment nut 2 and the top face 121 of the shoulder 12 of the locating socket 1 are made tapered, the adjustment nut 2 and the locating socket 1 are automatically aligned in a line when rotating the adjustment nut 2.

After adjustment of the elevation of the screw rod 7, attaching the wrench to the head 32 to rotate and fasten tight the lock screw 3. As illustrated in FIG. 3, when rotating the lock screw 3 downwards along the inner thread 11 of the locating socket I to force the bottom edge 34 against the top face 223 of the outward flange 222 of the adjustment nut 2, the bottom face 224 of the outward flange 222 of the adjustment nut 2 is forced against the top face 121 of the shoulder 12 of the locating socket 1, and therefore the locating socket 1, the adjustment nut 2, and the lock screw 3 are tightly secured in the locking position. Therefore, the elevation-adjustable rod member locking structure enables the screw rod 7 to be axially adjusted to the desired elevation, and can lock the screw rod 7 positively in the adjusted position. When locked, the screw rod 7 and the tubular upright post 8 are tightly secured together and prohibited from movement relative to each other. Therefore, the invention can bear compressive force as well as stretching force. Because the present invention is simple and easy to manufacture, it is applicable to different fields wildly.

When adjusting the elevation of the screw rod 7 again, loosen the lock screw 3 to release downward pressure from the outward flange 222 of the adjustment nut 2, and then rotate the adjustment nut 2 to move the screw rod 7 to the desired elevation. After adjustment, the lock screw 3 is fastened tight to force the bottom edge 34 against the top face 223 of the outward flange 222 of the adjustment nut 2 and the top face 121 of the shoulder 12 of the locating socket 1. Because the bottom edge 34 of the lock screw 3 and the top face 223 of the outward flange 222 of the adjustment nut 2 are made tapered, the lock screw 3 and the adjustment nut 2 are automatically aligned in a line when rotating the lock screw 3.

According to this embodiment, the locating socket 1 further comprises a first side screw hole 14, and a first tightening up screw 4 threaded into the first side screw hole 14 and stopped against the lock screw 3 to prohibit the lock screw 3 from rotation relative to the locating socket 1. Further, the locating socket 1 can be made having a second side screw hole 15 and a second tightening up screw 5 threaded into the second side screw hole 15 and stopped against the screw rod 7 to prohibit the screw rod 7 from rotary motion relative to the adjustment nut 2.

Figure 4:
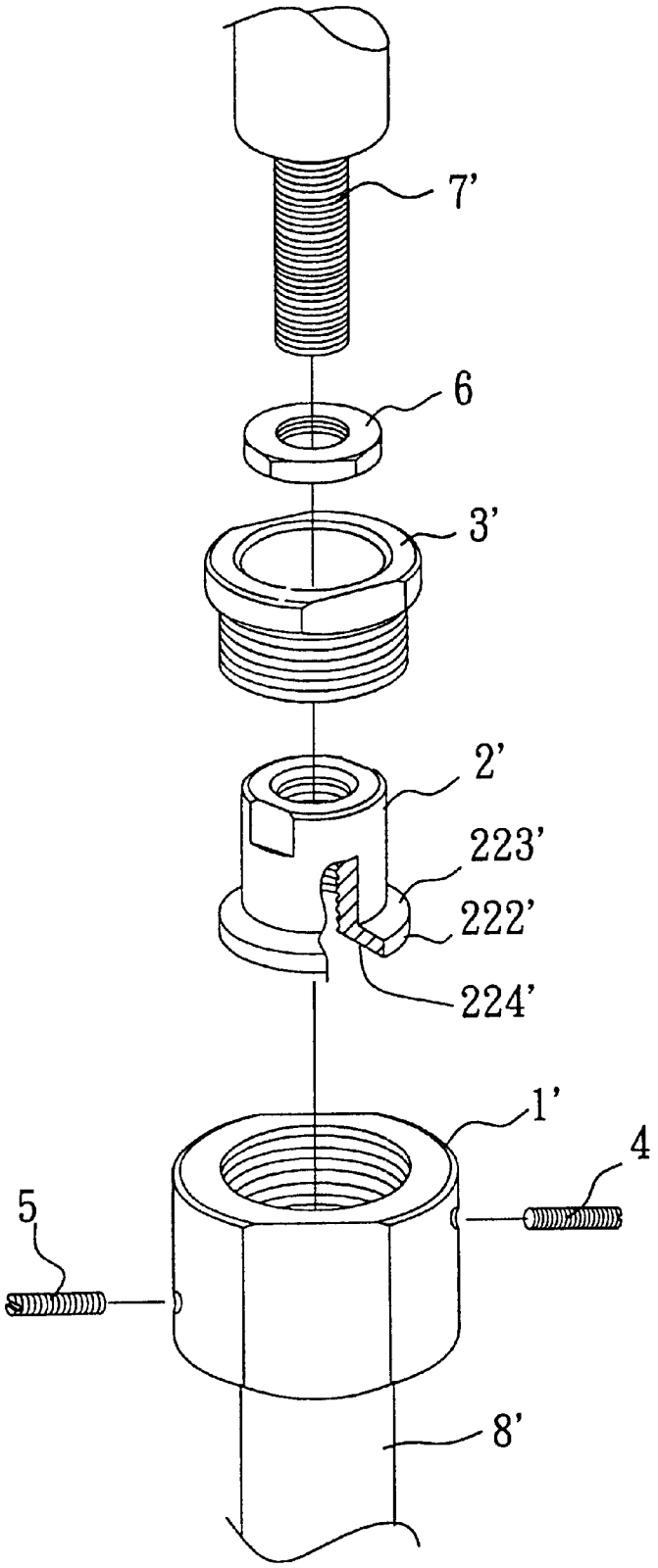
FIG. 4 is an exploded view of an elevation-adjustable rod member locking structure according to a second embodiment of the present invention.
Figure 5:
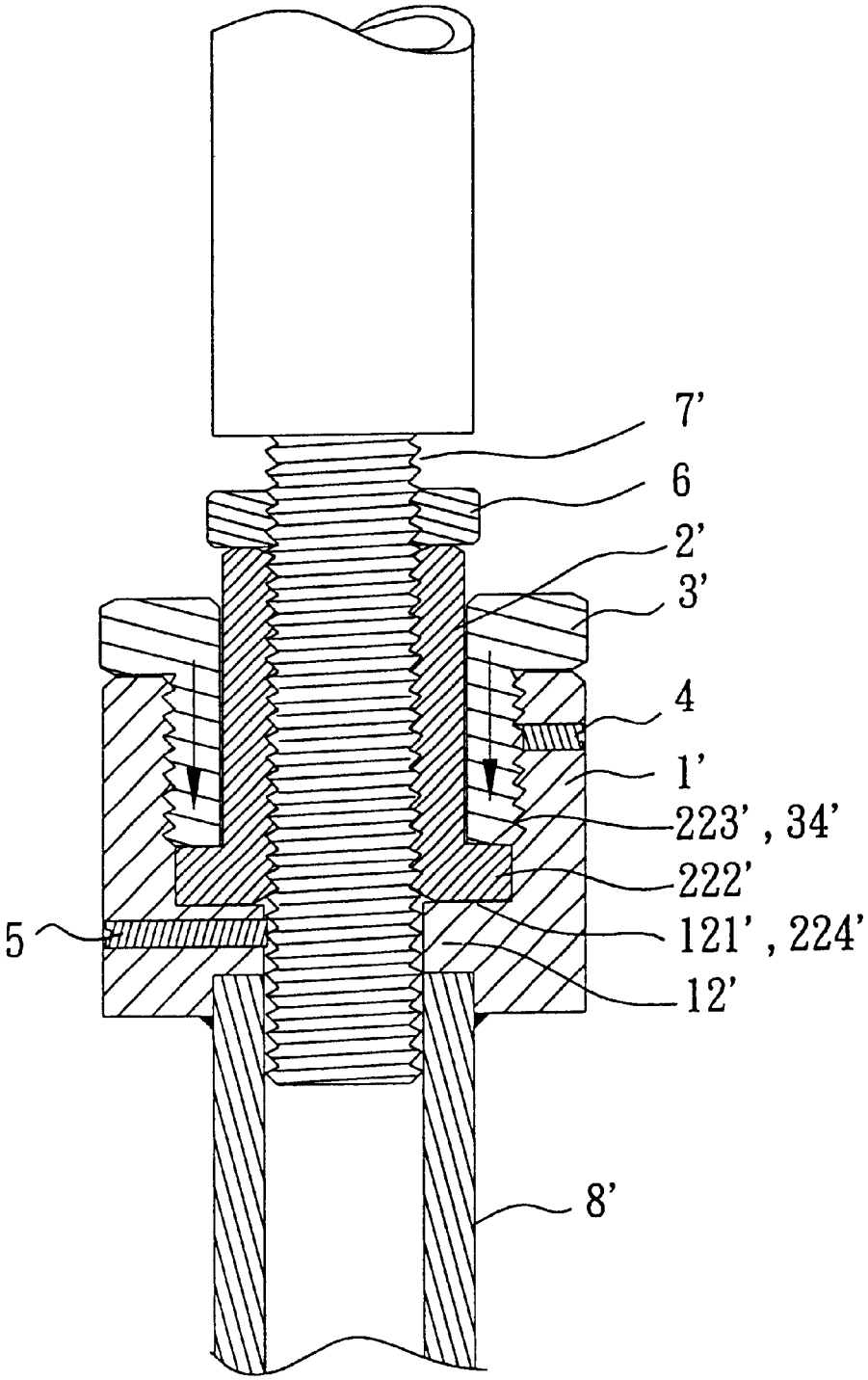
FIG. 5 is a sectional assembly view in an enlarged scale of the second embodiment of the present invention.
Figure 6:
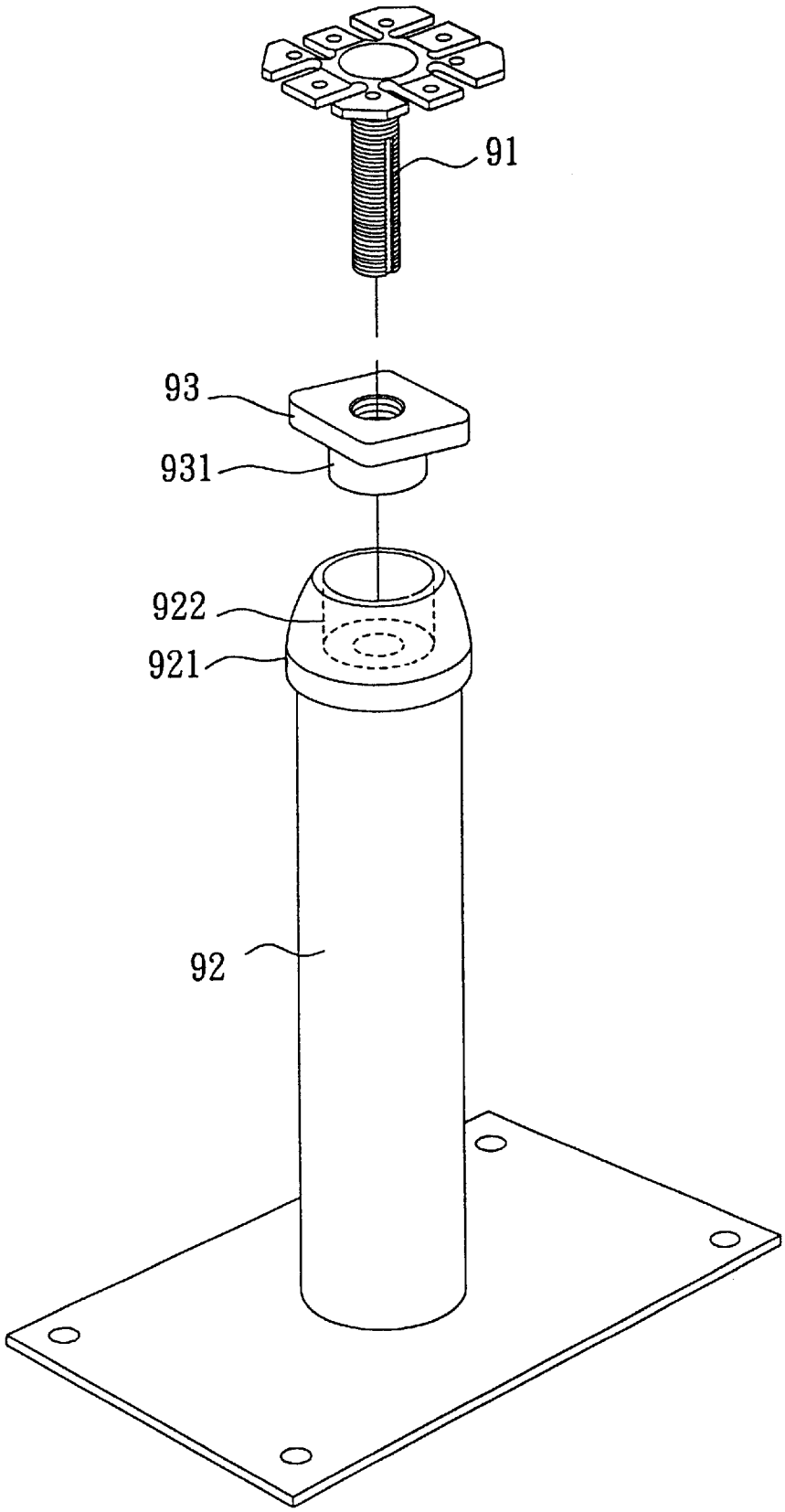
Fig. 6 (PRIOR ART)
FIG. 6 is an exploded view of an elevation-adjustable upright support for supporting a raised floor according to the prior art.

FIGS. 4 and 5 show an alternate form of the present invention. This embodiment is designed for use in a scaffold to adjust the elevation between a screw rod 7' and a tubular upright post 8'. Because the precision of a scaffold is less critical, the top face 223' and bottom face 224' of the outward flange 222' of the adjustment nut 2', the bottom edge 34' of the lock screw 3, and the top face 121' of the shoulder 12' of the locating socket 1 are not tapered for the sake of cost down.

Although the present invention has been explained in relation to its preferred embodiments, it is to be understood that many other possible modifications and variations can be made without departing from the spirit and scope of the invention as hereinafter claimed.

What is claimed is:

1. An elevation-adjustable rod member locking structure provided between a tubular upright post and a screw rod and adapted to adjust the elevation of said screw rod relative to said tubular upright post and to lock said screw rod in the adjusted position, comprising:

a locating socket fixedly fastened to an end of said tubular upright post, said locating socket comprising an inner thread extended to a top side thereof and a shoulder inwardly disposed at a bottom side thereof, said shoulder having a top face;

an adjustment nut mounted inside said locating socket and supported on said shoulder, said adjustment nut comprising an inner thread threaded onto said screw rod, a peripheral wall, an operation unit at an upper part of said peripheral wall, and an outward flange at a bottom side of said peripheral wall, said outward flange having a top face and a bottom face supported on the top face of said shoulder of said locating socket; and a lock screw adapted to lock said adjustment nut in said locating socket, said lock screw comprising an annular inside wall sleeved onto the peripheral wall of said adjustment nut, a head around the periphery thereof at a top side, an outer thread threaded into the inner thread of said locating socket, and a bottom edge supported on the top face of said outward flange of said adjustment nut.

2. The elevation-adjustable rod member locking structure as claimed in claim 1, wherein the top face of said shoulder of said locating socket is a tapered surface, and the bottom face of said outward flange of said adjustment nut is a tapered surface matching the tapered surface of the top face of said shoulder of said locating socket.

3. The elevation-adjustable rod member locking structure as claimed in claim 1, wherein the top face of said outward flange of said adjustment nut is a tapered surface, and the bottom edge of said lock screw is a tapered surface matching the tapered surface of the top face of said outward flange of said adjustment nut.

4. The elevation-adjustable rod member locking structure as claimed in claim 1, wherein said locating socket further comprises a first side screw hole, and a first tightening up screw threaded into said first side screw hole and adapted to stop said lock screw from rotary motion relative to said locating socket.

5. The elevation-adjustable rod member locking structure as claimed in claim 1, wherein said locating socket further comprises a second side screw hole, and a second tightening up screw threaded into said second side screw hole and adapted to stop said screw rod from rotary motion relative to said adjustment nut.

6. The elevation-adjustable rod member locking structure as claimed in claim 1 further comprising a check nut threaded onto said screw rod and stopped at the topmost edge of said adjustment nut.

* * * * *